United States Patent [19]

Stein

[11] 4,184,103

[45] Jan. 15, 1980

[54] GAS DISCHARGE LAMP BALLAST WITH EQUALLY SPACED WINDINGS

[75] Inventor: Michael A. Stein, Wayne, N.J.

[73] Assignee: Universal Manufacturing Corporation, Paterson, N.J.

[21] Appl. No.: 902,791

[22] Filed: May 4, 1978

[51] Int. Cl.[2] ..... H05B 41/14; H05B 4/36

[52] U.S. Cl. ..... 315/276; 315/277; 315/289; 315/DIG. 7

[58] Field of Search ..... 315/276, 277, 278, 282, 315/283, 289, DIG. 7

[56] References Cited

U.S. PATENT DOCUMENTS

| | | | |
|---|---|---|---|
| 3,374,396 | 3/1968 | Bell et al. | 315/277 |
| 3,476,977 | 11/1969 | Hallay | 315/289 |

*Primary Examiner*—Eugene R. LaRoche

[57] ABSTRACT

A lamp ballast is disclosed which includes a main winding, and an auxiliary winding connected in series with the main winding. The auxiliary winding is wound concentrically with the main winding and with substantially fewer turns than it. The pitch (space between two adjacent turns) of the auxiliary winding is much higher than that of the main winding so that the turns of the auxiliary winding are spaced over the entire length of the main winding. When a voltage pulse of comparatively low amplitude is applied across the auxiliary winding by a conventional electronic lamp starter, a substantially higher amplitude pulse, which is sufficient to ignite a sodium lamp appears across the main winding, by reason of the improved transformer action between the two windings. Thereafter, the ballast provides sufficient support to the lamp to keep it on.

7 Claims, 3 Drawing Figures

FIG. 1
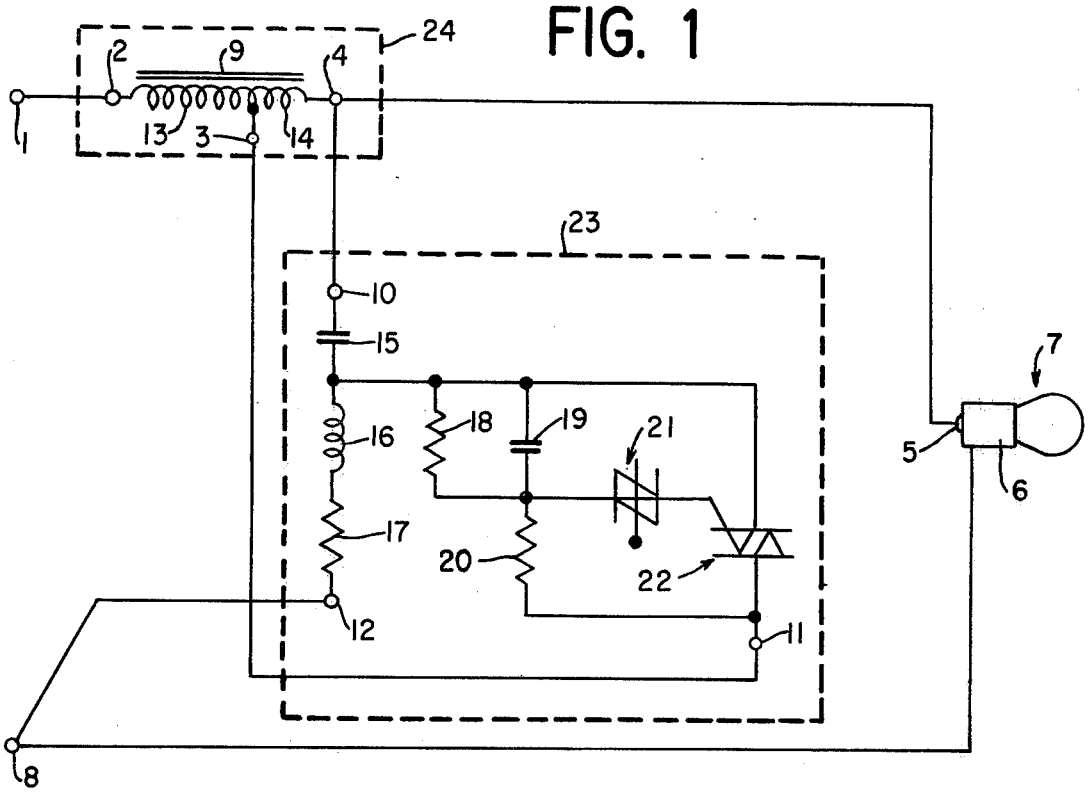
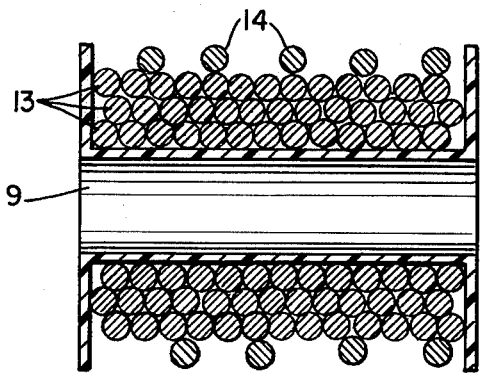
FIG. 2
FIG. 3
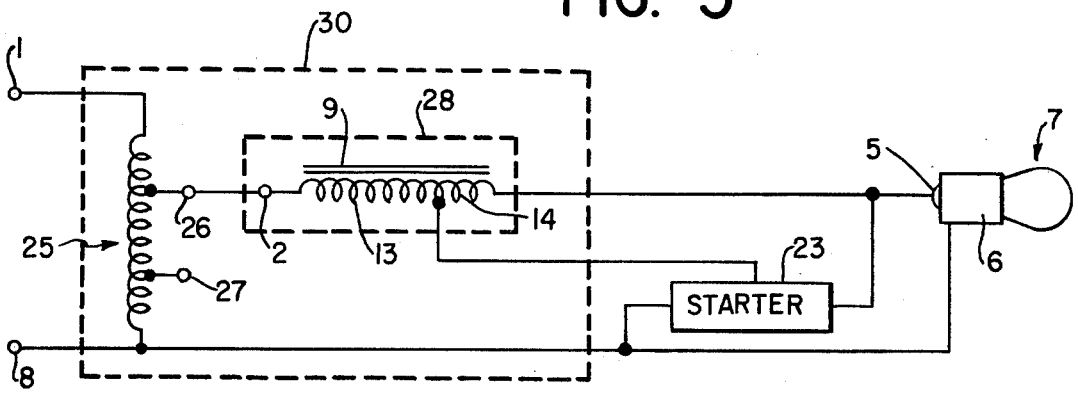

GAS DISCHARGE LAMP BALLAST WITH EQUALLY SPACED WINDINGS

This invention relates generally to lamp ballasts and in particular to ballasts for gas discharge lamps, such as high pressure sodium lamps.

Generally, to initiate the flow of current through a sodium lamp a voltage pulse of comparatively high amplitude must be applied across the lamp. For example, a conventional S62 lamp requires a starting pulse which reaches a peak amplitude of at least 2500 volts and remains above 2250 volts for at least one microsecond. Typically, such a starting pulse is obtained with the aid of a conventional electronic lamp starter such as Universal Manufacturing Corp., Catalogue No. HPS-150-1. This starter is a three terminal device in which the application of an AC voltage between two terminals serving as sensing terminals causes a voltage pulse to appear between two terminals serving as output terminals after some delay. In a typical arrangement, the lamp to be ignited is connected in series with the ballast and an A.C. voltage source, the output terminals of the starter are connected across the last few turns of the ballast, and the sensing terminals of the starter are connected across the A.C. source when it is desired to ignite the lamp. When a voltage pulse appears between the output terminals of the starter, a pulse of substantially greater amplitude is induced across the entire ballast as a result of the autotransformer action between the last few turns of the ballast and the rest of its turns. Inasmuch as the ballast is in series with the lamp, this induced pulse is applied to the lamp to ignite it. However, this arrangement cannot consistently and reliably provide a voltage pulse of sufficient amplitude to ignite a lamp such as the S62 when existing starters and ballasts are used.

Various voltage step-up transformers have been available for high voltage pulse applications. For example, U.S. Pat. No. 2,619,513 of Wolfenbarger discloses such a transformer which is useful as an automobile ignition coil. Such prior art transformers, although effective for stepping up a signal of high voltage, low energy pulses, would be unsuitable for use as a ballast, which must not only provide a high voltage pulse to ignite a high pressure sodium lamp but must also be capable of carrying sufficient current to keep the lamp lit. Such prior art transformers also cannot provide the choking effect necessary to limit the steady state current flow through the lamp after it has been started.

It is an object of the present invention to provide a lamp ballast which, when used in combination with a standard lamp starter such as the HPS-150-1, can provide a starting pulse sufficient to ignite a high pressure sodium lamp, and the necessary steady-state current flow through the lamp to keep it lit at its specified current and wattage, in addition to providing choking to control the current flow.

It is a further object of the present invention to provide a lamp ballast meeting at least one of the other objects herein which is capable of maintaining steady-state operation with a lamp which is incapable of operating with an A.C. source having the voltage amplitude of the available source.

It is also an object of the present invention to provide a ballast of the type described which is relatively simple and inexpensive in construction, yet durable and reliable in use.

In accordance with the invention, a lamp ballast is provided which comprises a main inductive winding and an auxiliary inductive winding wound in series around a common core. The auxiliary winding is preferably wound on one layer with fewer turns per layer than in the main winding. The pitch (space between two adjacent turns) of the auxiliary winding is substantially greater than that of the main winding. Thus the turns of the auxiliary winding are spaced across substantially the entire length of the main winding so as to be substantially coextensive or preferably coextensive with the main winding.

In a first illustrative embodiment, the main and auxiliary windings described are connected in series with the lamp to be ignited and an AC voltage source. A conventional lamp starter is connected to sense the AC voltage source at its input terminals. The output terminals of the starter are connected across the auxiliary winding. In operation, when the starter produces a starting pulse, a pulse of substantially greater amplitude appears across the serially connected windings and ignites the lamp. Thereafter, current to maintain the lamp in its illuminated condition is provided from the AC source through the serially connected main and auxiliary windings which serve as a choking reactor in series with the lamp.

In a second illustrative embodiment, the AC source is connected across a primary coil which cooperates with a composite winding comprising the serially connected main and auxiliary windings to define a transformer in which the composite winding is the secondary. This permits the voltage amplitude of the AC source to be stepped up or stepped down through transformer action and thereby permits operation with an AC source whose voltage amplitude is greater or lesser that that required to ignite the lamp and maintain it illuminated after its initial firing.

The foregoing brief description, as well as further objects, features and advantages of the present invention will be more fully understood by reference to the following detailed description of two presently preferred, but nonetheless illustrative, embodiments in accordance with the present invention when taken in conjunction with the accompanying drawings wherein:

FIG. 1 is a circuit schematic diagram illustrating how a first preferred embodiment of the invention is utilized with a conventional starter to ignite a high pressure sodium lamp;

FIG. 2 is a cross-sectional diagram of the lamp ballast showing the relationship between the core of the ballast and the main and auxiliary windings which are wound thereon; and FIG. 3 is a circuit schematic diagram, similar to FIG. 1, illustrating how a second preferred embodiment of the invention is to operate a lamp with an A.C. source having a voltage amplitude which is either too high or too low to operate the lamp in its steady-state.

It has been found that a ballast having the turns of its auxiliary winding spaced so as to be axially coextensive with the turns of its main winding produces a higher amplitude output pulse, responsive to a given input pulse, than do prior art ballasts with the same turns ratio between the auxiliary and main windings. This effect is believed to be a result of the tighter inductive coupling provided between the windings by their axially coextensive arrangement.

Referring to FIGS. 1 and 2, there is shown a lamp ballast 24 of the present invention which includes a main winding 13 wound about core 9. Auxiliary winding 14, which is connected in series with main winding 13, is wound about winding 13 so as to be axially coextensive with main winding 13, as illustrated in FIG. 2. FIG. 2 also illustrates that main winding 13 contains a substantially greater number of turns than auxiliary winding 14. This auxiliary winding 14 is preferably wound on one layer with fewer turns per layer than in the main winding 13. The turns of the auxiliary winding 14 are preferably equally spaced along the entire length of main winding 13. An input terminal 2 is provided at one end of main winding 13 and an output terminal 4 is provided at one end of auxiliary winding 14. A tap terminal 3 is provided at the point of connection of main winding 13 and auxiliary winding 14.

The circuit of FIG. 1 also includes a conventional lamp starter 23. For the purpose of this illustrative embodiment lamp starter 23 is of the type manufactured by Universal Manufacturing Corp. and designated Catalogue No. HPS-150-1. It will be appreciated, however, that suitable substitutes would be apparent to practitioners of the art, and that the present invention would be equally applicable to circuits employing these substitutes. Starter 23 includes a first terminal 10 which is connected to output terminal 4 of ballast 24, a second terminal 12, and a third terminal 11 which is connected to tap terminal 3 of ballast 24. Lamp 7 is connected across first terminal 10 and second terminal 12 of starter 23. Second terminal 12 is also connected to common terminal 8.

To operate the circuit illustrated in FIG. 1 an AC source voltage is applied between input terminal 2 and common terminal 8. Starter 23 senses the application of the AC source voltage between terminal 10 and terminal 12. Starter 23 senses when voltage between terminals 10 and 12 reaches a predetermined amplitude and, in response, generates a voltage pulse between terminals 10 and 11.

This voltage pulse is applied across tap terminal 3 and output terminal 4 of ballast 24. As a result of the autotransformer action between auxiliary winding 14 and main winding 13 a substantially higher voltage pulse is induced at output terminal 4. This pulse is applied to lamp 7, causing it to ignite. After ignition, the current necessary to maintain lamp 7 illuminated is supplied through the choking reactor formed by the series connection of main winding 13 and auxiliary winding 14.

The operation of the circuit of FIG. 1 will be better understood if the operation of the circuits comprising starter 23 is considered. When the AC source voltage is applied across power terminal 1 and common terminal 8, current instantaneously flows through input terminal 2, main winding 13, auxiliary winding 14, terminals 4 and 10, capacitor 15, inductor 16, and resistor 17, then back to common terminal 8, thereby causing capacitor 15 is begin charging. Simultaneously, current also flows from power terminal 1 through input terminal 2, auxiliary coil 13, tap terminal 3, terminal 11 of lamp starter 23, resistor 20, capacitor 19, inductor 16, resistor 17 and thence back to common terminal 8, thereby causing capacitor 19 to also begin charging. At this time, lamp 7 is not yet activated and no current flows through it.

When capacitor 19 is charged to a value of between 7.5 and 9.0 volts, bilateral switch 21 is conditioned to conduct, thereby enabling triac 22 to conduct. When triac 22 conducts, capacitor 15 discharges through triac 22, terminal 11, tap terminal 3, auxiliary winding 14, and output terminal 4. This discharge appears as a pulse of current through auxiliary winding 14.

Due to transformer action between auxiliary winding 14 and main winding 13 a voltage pulse is induced across main winding 13, the amplitude of which pulse is higher than that winding 13, the amplitude of which pulse is higher than that of the pulse applied across auxiliary winding 14 by reason of the comparatively greater number of turns contained in main winding 13. This voltage pulse across main winding 13 is maximized to provide a sufficient voltage to ignite lamp 7, owing to the tight inductive coupling between main winding 13 and auxiliary winding 14, which results from the axially coextensive relationship between the main winding 13 and auxiliary winding 14.

The voltage pulse which appears across main winding 13 appears in series with the AC source across terminals 5 and 6 of lamp 7 and ignites lamp 7 so that it starts conducting current provided from the AC source through serially connected windings 13 and 14. The voltage amplitude of the AC source is selected to be sufficient to provide a steady state current flow through lamp 7 which is limited by the choking effect of ballast 24. The starting of lamp 7 results in the voltage across starter terminals 10 and 12 being reduced, thereby deactivating starter 23.

Referring now to FIG. 3, there is shown a second preferred embodiment of the invention, including a ballast 24 which has a primary coil 25 coupled in transformer relationship with a composite coil 28 comprising the serially connected main winding 13 and auxiliary winding 14, which here define a secondary coil of a transformer 30. This coupling could be achieved, for example, by winding coil 25 concentrically with windings 13 and 14. One end of primary coil 25 is connected to power terminal 1 for connection with the "hot" side of the AC source. The other end of primary coil 25 is connected to common terminal 8 for connection to the common side of the AC source.

Primary coil 25 is also provided with one or more driving terminals such as driving terminals 26 and 27. The combination of primary coil 25 and composite winding 28, formed by the series combination of main winding 13 and auxiliary winding 14, forms a transformer 30 for transforming the AC voltage supplied by the AC source to the AC voltage required for steady state operation of the particular type of lamp 7 used.

In the illustrative embodiment of FIG. 3, driving terminal 26 is connected to input terminal 2 and the AC source is connected between power terminal 27 and common 8. Inasmuch as terminal 27 is at an intermediate point on coil 25, there is autotransformer action between the lower portion of coil 25 (between terminals 27 and 8) and the entire coil. As a result, the voltage between terminals 26 and 8 is stepped up in proportion to the ratio of the number of turns in coil 25 to the number of turns in the lower portion thereof. It will be appreciated that further stepping up of the voltage across lamp 7 could be achieved by adjusting the turns ratio between primary coil 25 and secondary coil 28. It will also be appreciated that stepping down of the AC voltage could be achieved by appropriate adjustment of the various turns ratios.

In the second embodiment, stepping up the voltage of the AC source permits steady state illumination with a source having a voltage amplitude which would otherwise be insufficient for this purpose. By proper location of tap terminal 27 of the primary coil 25, the ballast of the present invention may be adapted for use with different AC source voltages, or, if an AC source of given voltage amplitude is used, with a variety of lamp types, each of which may require a different AC voltage for maintaining steady state current flow.

In all other respects, the operation of the embodiment of the invention illustrated by FIG. 3 is similar to the embodiment illustrated by FIG. 1.

Although specific embodiments of the invention have been described for illustrative purposes, it will be appreciated by one skilled in the art that many modifications, additions and substitutions are possible without departing from the scope and spirit of the invention.

What is claimed is:

1. A lamp ballast circuit for igniting and maintaining illuminated a gas filled lamp comprising:

an input terminal and a common terminal, said terminals being adapted to be connected to a source of AC power;

an output terminal, said lamp adapted to be connected between said output terminal and said common terminal;

a tap terminal;

a main inductive winding wound with a predetermined pitch connected between said input terminal and said tap terminal;

an auxiliary inductive winding having substantially fewer turns than said main winding and being wound concentrically therewith with a substantially greater pitch than the main winding, said auxiliary winding being connected between said tap and output terminals, the series combination of said main winding and said auxiliary winding forming a composite autotransformer winding; and a starter having first, second and third terminals connected to said output, common and tap terminals, respectively, said starter including enabling means responsive to a voltage between said second and said first terminals for producing an enabling signal when said voltage exceeds a predetermined amplitude, and means responsive to said enabling signal for generating a voltage pulse between said first and third terminals, so that a high amplitude voltage pulse is produced across said lamp as a result of the autotransformer action between said main and auxiliary windings, the serial connection of said windings forming an inductive load in series with said lamp in the absence of said enabling signal.

2. A ballast circuit in accordance with claim 1 wherein said auxiliary winding is substantially co-extensive therewith.

3. A ballast circuit in accordance with claim 1 wherein said main and auxiliary windings are concentrically wound on a common core.

4. A ballast circuit in accordance with claim 1 wherein said input and common terminals are connected to a source of AC power.

5. A ballast circuit in accordance with claim 1 further comprising a power terminal and a primary winding connected between said power terminal and said common terminal and being constructed and arranged to be inductively coupled with said composite winding, said primary winding having a driving terminal disposed intermediate its ends, said input terminal being connected to one of said power and driving terminals, said composite winding coacting with said primary winding when a source of power is provided between said power common terminal and the other one of said power and driving terminals, so that power is provided to said lamp through the transformer action between said primary and composite windings.

6. A ballast circuit in accordance with claim 5 wherein common terminal and the other one of said power and driving terminals are connected to a source of AC power.

7. A ballast circuit in accordance with claim 5 wherein said main and auxiliary windings are concentrically wound on a common core.

* * * * *